US007828224B2

(12) United States Patent
Yang

(10) Patent No.: US 7,828,224 B2
(45) Date of Patent: Nov. 9, 2010

(54) AIR CONDITIONING DIFFUSER HAVING FUNCTION OF AUTOMATICALLY CHANGING AIR SUPPLY DIRECTION

(75) Inventor: Hong Sun Yang, Gwangju-si (KR)

(73) Assignee: Sun IL Engineering Co., Ltd., Gwangju-Si, Gyeonggi-Do (KR)

( * ) Notice: Subject to any disclaimer, the term of this patent is extended or adjusted under 35 U.S.C. 154(b) by 516 days.

(21) Appl. No.: 11/915,034

(22) PCT Filed: Dec. 26, 2005

(86) PCT No.: PCT/KR2005/004544

§ 371 (c)(1),
(2), (4) Date: Nov. 20, 2007

(87) PCT Pub. No.: WO2007/001111

PCT Pub. Date: Jan. 4, 2007

(65) Prior Publication Data

US 2008/0210767 A1 Sep. 4, 2008

(30) Foreign Application Priority Data

Jun. 27, 2005 (KR) ..... 20-2005-0018431

(51) Int. Cl.
*F24F 7/00* (2006.01)

(52) U.S. Cl. ..... 236/49.1; 236/49.5; 236/86; 236/99 B; 454/258; 416/39

(58) Field of Classification Search ..... 236/49.1, 236/49.5, 86, 99 R, 99 B, 258; 415/48; 416/39, 416/59, 162–164, 168 R
See application file for complete search history.

(56) References Cited

U.S. PATENT DOCUMENTS 5,647,532 A * 7/1997 de Villiers et al. ..... 236/49.5
6,702,187 B2 3/2004 van der Merwe

FOREIGN PATENT DOCUMENTS

JP 07-234009 9/1995

* cited by examiner

*Primary Examiner*—Cheryl J Tyler
*Assistant Examiner*—Jonathan Bradford
(74) *Attorney, Agent, or Firm*—IPLA P.A.; James E. Bame

(57) ABSTRACT

Disclosed herein is an air conditioning diffuser having a function of changing an air supply direction. The diffuser of the present invention includes a frame (10) and a temperature sensing cylinder (20), which is coupled to the frame (10). A wax (21) is charged in the cylinder (20), and a piston rod (22) is provided in the cylinder (20). The diffuser further includes a blade support body (50), coupled to the cylinder (20), a pushing member (23), coupled to the piston rod in the blade support body, and a vertical movable member (40), which is provided in the blade support body (40) and is pushed downwards by the pushing member (23) when the wax is expanded. The diffuser further includes air guide blade assemblies (30), which are supported by the blade support body (50) and are coupled to the vertical movable member (40) so that, when the vertical movable member is moved upwards or downwards, blades (35) are rotated. An elastic member is provided under the vertical movable member (40).

5 Claims, 11 Drawing Sheets

AIR CONDITIONING DIFFUSER HAVING FUNCTION OF AUTOMATICALLY CHANGING AIR SUPPLY DIRECTION

TECHNICAL FIELD

The present invention relates, in general, to air conditioning diffusers which are installed in ceilings of rooms of buildings to supply cold or hot air discharged from air conditioners into rooms and, more particularly, to an air conditioning diffuser which has an improved structure such that a direction in which cold or hot air is discharged into a room is automatically changed depending on the temperature of the cold or hot air.

BACKGROUND ART

As well known to those skilled in the art, in an air conditioning system provided in a building for air conditioning of rooms, a diffuser is installed in the ceiling of the room, so that cold air is supplied into a room therethrough in the summer and hot air is supplied into the room therethrough in the winter.

In the room, convection currents, in which hot air rises while cold air sinks, always arise. Therefore, it is preferable that the diffuser be set such that cold air is supplied from the diffuser towards the ceiling and hot air is vertically supplied from the diffuser towards the bottom of the room.

In other words, when cold air is supplied towards the ceiling, the cold air can be dispersed from the ceiling towards the bottom of the room by convection. Thus, air-cooling is efficiently executed. As well, because the cold air is not directly blown towards people in front of the diffuser, the people are prevented from becoming excessively chilled.

Meanwhile, when hot air is supplied towards the bottom of the room, the hot air can be dispersed from the bottom towards the ceiling by convection, thus promoting efficient and rapid air-heating.

For ease of description, the supply of air from the diffuser towards the ceiling is described as the horizontal air supply, and the supply of air from the diffuser towards the bottom is described as the vertical air supply.

Although diffusers, which supply cold or hot air in a horizontal or vertical direction, have been proposed, most of the conventional diffusers are manually manipulated. Therefore, each season the conventional arts require users to change air supply direction of all diffusers, which are installed in many rooms of the building, thus inconveniencing the users.

To solve the above-mentioned problems, recently, diffusers that change an air supply direction using a temperature sensing cylinder having therein a wax that is expanded or contracted depending on the temperature of supply air, have been developed. However, because these diffusers have complex structures, there are problems in that the incidence of malfunction is increased and an air supply direction may be incorrectly changed.

DISCLOSURE OF INVENTION

Technical Problem

Accordingly, the present invention has been made keeping in mind the above problems occurring in the prior art, and an object of the present invention is to provide an air conditioning diffuser which has a function of automatically changing a direction in which cold or hot air is discharged into a room according to a temperature of the cold or hot air.

Another object of the present invention provides an air conditioning diffuser which has a structure such that the operation of changing an air supply direction is smoothly executed.

Technical Solution

In order to accomplish the above object(s), the present invention provides an air conditioning diffuser having a function of automatically changing an air supply direction, including: a frame fastened to a ceiling of a room and communicating with an air duct through which cold or hot air passes, with an air passage defined in the frame so that the cold or hot air is supplied from the air duct to the room through the air passage; a temperature sensing cylinder mounted to a support bracket fastened to the frame in the air passage, with a wax charged in the temperature sensing cylinder to expand or contract depending on a temperature of the cold or hot air passing through the air passage, and a piston rod provided in the temperature sensing cylinder such that the piston rod is advanced from a lower end of the temperature sensing cylinder by expansion of the wax; a blade support body coupled to the lower end of the temperature sensing cylinder using coupling means, with a plurality of removal prevention supports provided in a circumferential outer rim of the blade support body and spaced apart from each other at regular angular intervals, and a plurality of rotating shaft seats formed in the respective removal prevention supports and in an outside wall of the rim; a pushing member coupled to a lower end of the piston rod and placed in the blade support body; a vertical movable member provided in a space defined in the blade support body to ensure movement of the vertical movable member therein, the vertical movable member being pushed downwards by the pushing member when the wax is expanded, with a plurality of eccentric shaft seats formed around an intermediate portion on a circumferential outer surface of the vertical movable member and spaced apart from each other at regular angular intervals; a plurality of air guide blade assemblies supported by the blade support body, each of the air guide blade assemblies comprising: a blade exposed outside the blade support body; a rotating shaft extending from the blade and rotatably seated in the respective rotating shaft seats of the blade support body, with a stopper provided on an outer surface of the rotating shaft and stopped by each of the removal prevention supports of the blade support body; a connection part extending from the rotating shaft in a predetermined direction; and an eccentric rotating shaft protruding from the connection part so as to be eccentric from the rotating shaft, the eccentric rotating shaft inserted into each of the eccentric shaft seats of the vertical movable body so that, when the vertical movable member is moved upwards or downwards, the eccentric rotating shafts are moved upwards or downwards, thereby the blades are rotated around the rotating shafts in a closing or opening direction; and an elastic member provided under the vertical movable member at a lower position in the space of the blade support body so that, when the vertical movable member is released from the pushing member by contraction of the wax of the temperature sensing cylinder, the elastic member biases the vertical movable member upwards.

The vertical movable member may comprise an upper body and a lower body, and the eccentric shaft seats may be formed in an upper surface of the lower body, so that the upper body is coupled to the lower body using locking means, while the eccentric rotating shafts of the air guide blade assemblies are inserted into the eccentric shaft seats of the lower body.

The blade support body may comprise an upper body and a lower body, so that the upper body and the lower body are coupled to each other using locking means, while the rotating shafts of the air guide blade assemblies are placed in the rotating shaft seats.

The coupling means for coupling the blade support body to the temperature sensing cylinder may include a threaded coupling hole formed in an upper end of the blade support body; and a lower threaded part provided on the lower end of the temperature sensing cylinder and engaging with the threaded coupling hole.

Each of the air guide blade assemblies may further include a coupling part provided on an end of the rotating shaft, with an insertion slot defined in the coupling part, so that the blade is inserted into the insertion slot and is fastened to the coupling part using locking means.

Advantageous Effects

In the present invention, an air conditioning diffuser has a function of automatically changing the direction in which cold or hot air is supplied into a room depending on the temperature of the air. Therefore, the present invention does not require a user to change an air supply direction of the diffuser according to each season, thus being more convenient for the user.

BEST MODE FOR CARRYING OUT THE INVENTION

Hereinafter, a preferred embodiment of the present invention will be described in detail with reference to the attached drawings.

Figure 1:
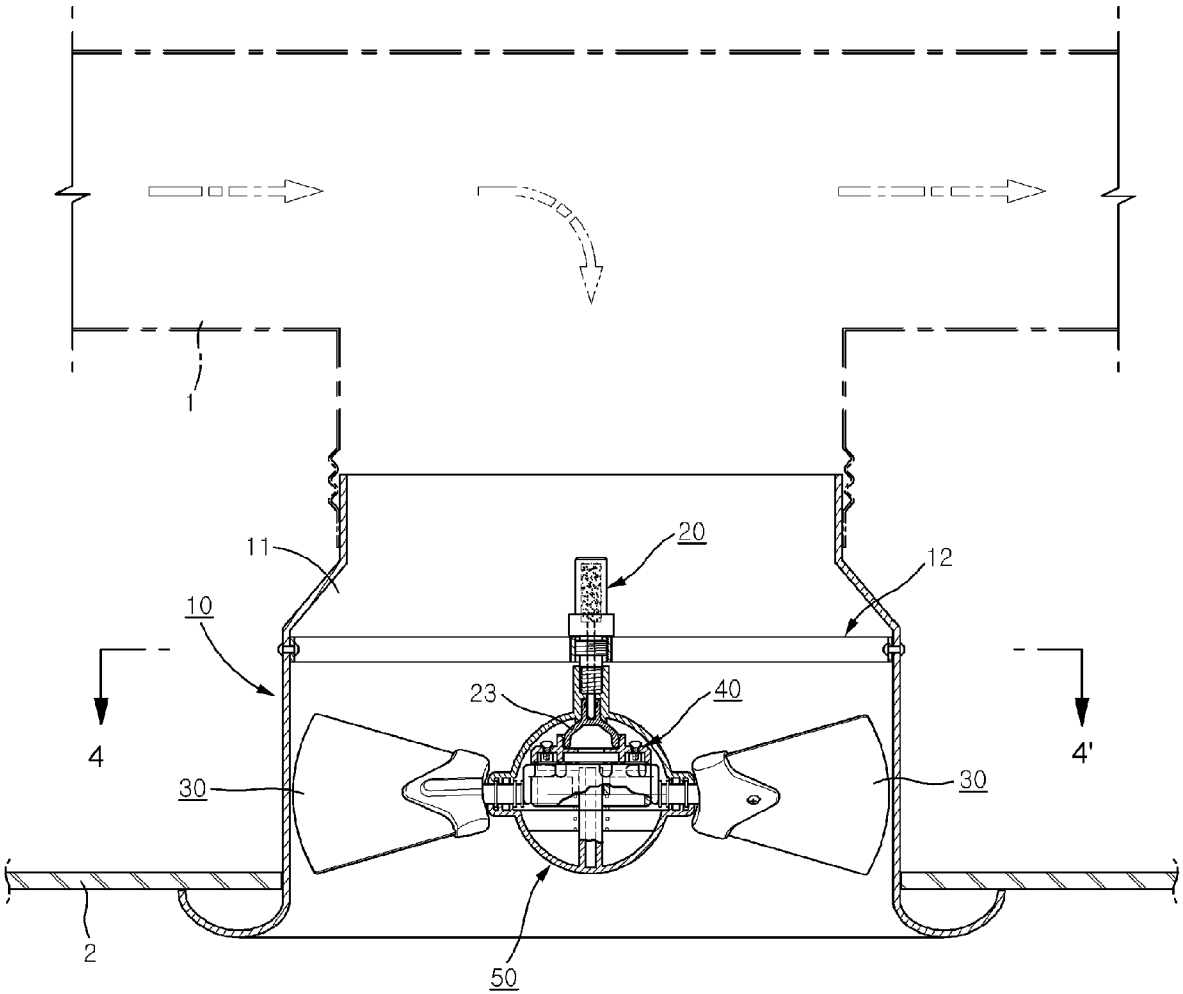
FIG. 1 is a sectional view of an air conditioning diffuser, according to an embodiment of the present invention.

FIG. 1 is a sectional view of an air conditioning diffuser, according to the preferred embodiment of the present invention. As shown in FIG. 1, the air conditioning diffuser according to the preferred embodiment of the present invention includes a frame 10 which defines therein an air passage 11, and a temperature sensing cylinder 20 which is supported by a support bracket 12 that is mounted to the frame 10 in the air passage 11. The air conditioning diffuser further includes a vertical movable member 40 which is pushed downwards by pressing force of a pushing member 23 that is moved by the operation of the temperature sensing cylinder 20, a blade support body 50 which covers the vertical movable member 40, and a plurality of air guide blade assemblies 30, which are supported by the blade support body 50.

In the air conditioning diffuser having the above-mentioned construction, the frame 10 is fastened to a ceiling 2 of a room such that cold or hot air can be supplied from an air duct 1 to the inside of the room through the air passage 11.

Figure 2:
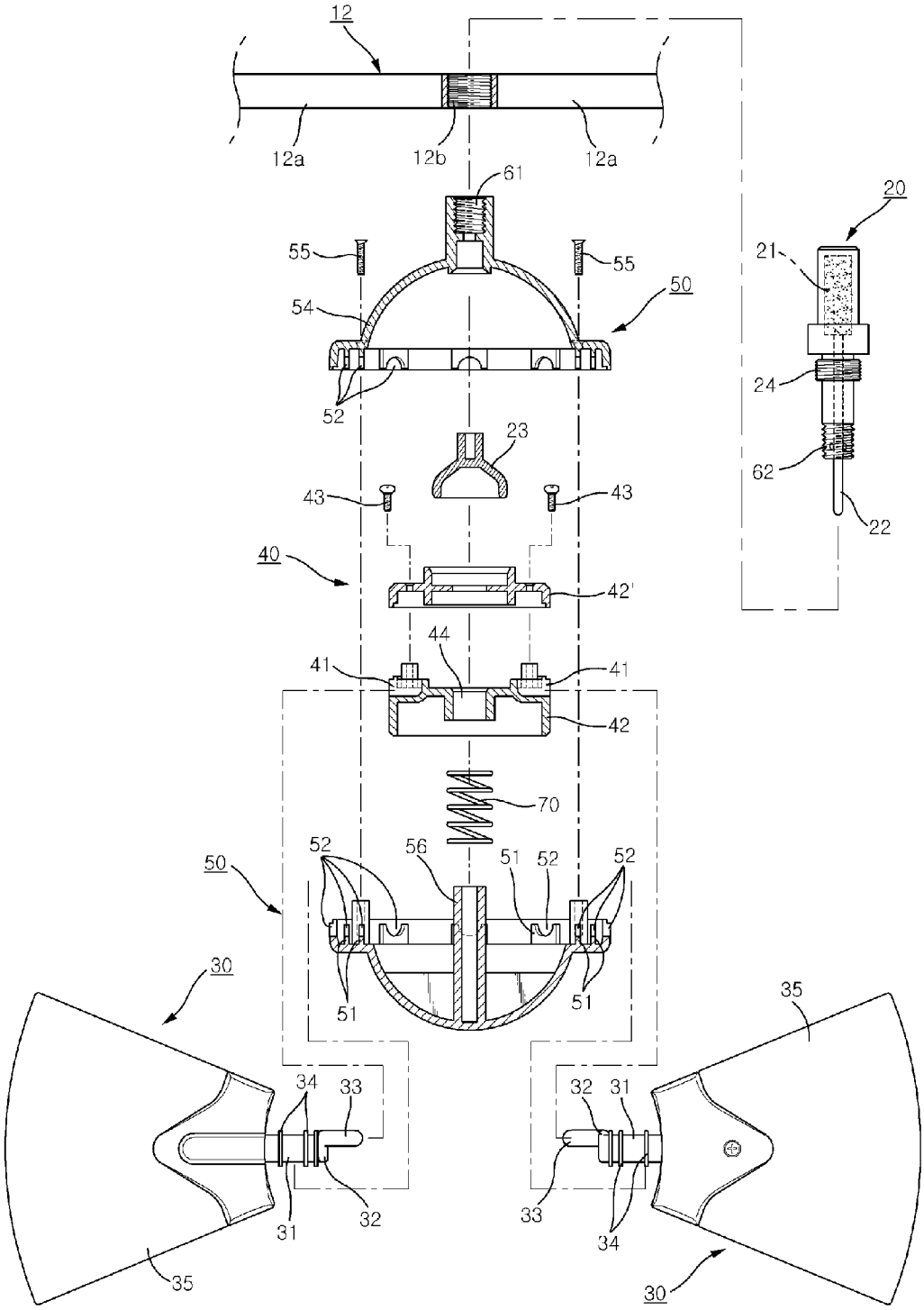
FIG. 2 is an exploded sectional view showing a critical part of the air conditioning diffuser of FIG. 1.
Figure 3:
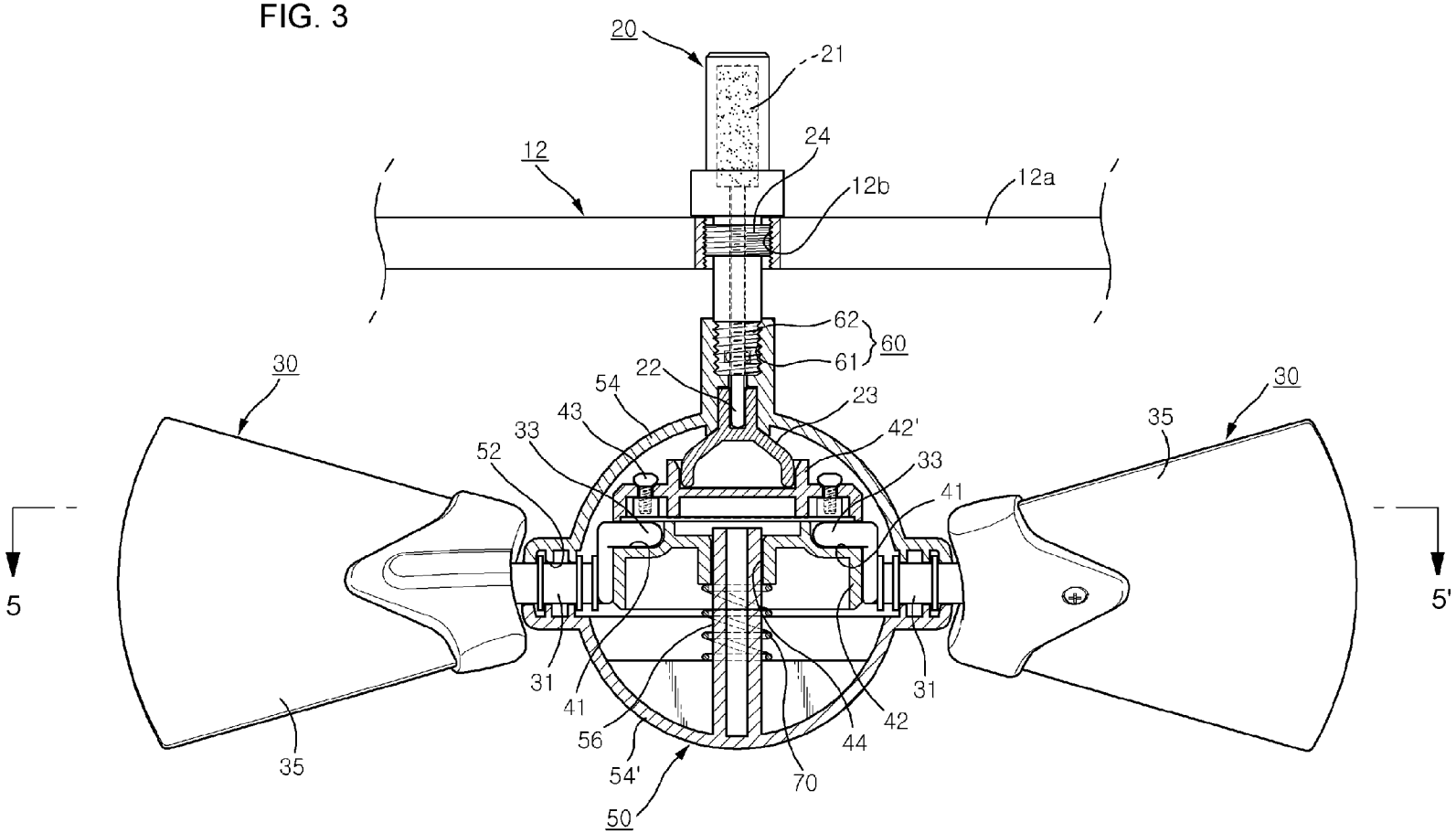
FIG. 3 is a sectional view showing the critical part of the air conditioning diffuser of FIG. 2 when supplying cold air.

Referring to FIGS. 2 and 3, the temperature sensing cylinder 20 is constructed such that a wax 21 charged in the temperature sensing cylinder 20 is expanded or contracted depending on the temperature of air passing through the air passage 11.

Described in detail, when hot air passes through the air passage 11, the hot air contacts the temperature sensing cylinder 20 and transfers heat to the wax 21, thereby the wax 21 is expanded in volume. Then, a piston rod 22, which is provided in the temperature sensing cylinder 20, is advanced. Conversely, when cold air passes through the air passage 11, the wax 21 gives heat to the air and is thus contracted. At this time, the piston rod 22 of the temperature sensing cylinder 20 is retracted.

Here, the retraction of the piston rod 22 is realized by elasticity of an elastic member 70, which will be explained later herein.

The temperature sensing cylinder 20 is a well-known element in the art. The temperature sensing cylinder 20 makes the air guide blade assemblies 30 rotatable.

Figure 4:
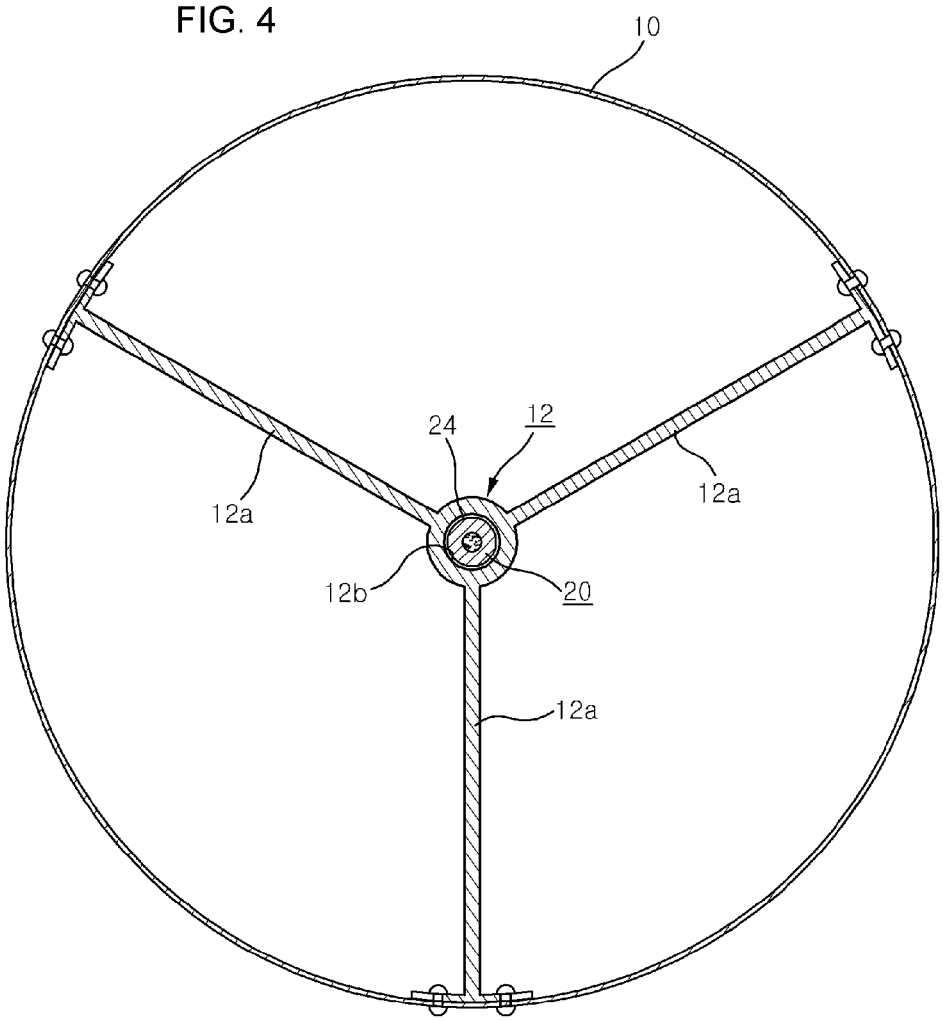
FIG. 4 is a sectional view taken along line X-X' of FIG. 1.

Furthermore, the temperature sensing cylinder 20 is supported by the support bracket 12, which is mounted to the frame 10 in the air passage 11. In detail, as shown in FIG. 4, leg parts **12*a* of the support bracket 12 are fastened to the inner surface of the frame 10 using fastening means such as rivets. A coupling hole 12*b* is formed at a central position in the support bracket 12, so that the temperature sensing cylinder 20 is fastened to the support bracket 12 by insertion of a coupling part 24 of the temperature sensing cylinder 20 into the coupling hole 12*b* of the support bracket 12**.

The pushing member 23 is coupled to the piston rod 22 of the temperature sensing cylinder 20, so that the vertical movable member 40 is moved downwards by the pushing force of the pushing member 23.

Meanwhile, eccentric shaft seats 41 are formed around an intermediate portion on a circumferential outer surface of the vertical movable member 40 and spaced apart from each other at regular angular intervals. A connection part 32 extends from a rotating shaft 31 of each air guide blade assembly 30 in a direction different from the rotating shaft 31. Furthermore, an eccentric rotating shaft 33 protrudes from the connection part 32 of each air guide blade assembly 30 so as to be eccentric from the rotating shaft 31. The eccentric rotating shafts 33 are inserted into the respective eccentric shaft seats 41 of the vertical movable member 40, so that the eccentric rotating shafts 33 are rotated upwards or downwards by upward or downward movement of the vertical movable member 40. Here, the vertical movable member 40 comprises an upper body 42' and a lower body 42. The eccentric shaft seats 41 are formed in the upper surface of the lower body 42. Thus, after the eccentric rotating shafts 33 are inserted into the eccentric shaft seats 41 of the lower body 42, the upper body 42' is coupled to the lower body 42 using screws 43.

Furthermore, the blade support body 50 is coupled to the lower end of the temperature sensing cylinder 20 using a coupling means 60. The vertical movable member 40 is provided in a space 53 defined in the blade support body 50 to ensure movement of the movable member 40 therein. Removal prevention supports 51 are provided in a circumferential outer rim of the blade support body 50 and spaced apart from each other at regular angular intervals. Rotating shaft seats 52 are formed in the respective removal prevention supports 51 and in the outside wall of the rim. The rotating shafts 31 of the air guide blade assemblies 30 are rotatably seated in the respective rotating shaft seats 52, while stoppers 34 provided on the rotating shafts 31 of the air guide blade assemblies 30 are stopped by the removal prevention supports 51. Thus, the air guide blade assemblies 30 are movably supported by the blade support body 50 so that blades 35 of the air guide blade assemblies 30, which are exposed outside of the blade support body 50, are rotatable.

The blade support body 50 is divided into upper and lower bodies 54 and 54'. The rotating shafts 31 of the air guide blade assemblies 30 are placed in the rotating shaft seats 52 before the upper and lower bodies 54 and 54' are assembled with each other using screws 55.

The coupling means 60 includes a threaded coupling hole 61, which is formed in the upper end of the blade support body 50, and a lower threaded part 62, which is provided on the lower end of the temperature sensing cylinder 20 and engages with the threaded coupling hole 61, thus maintaining the blade support body 50 in a stable position.

Not shown in the drawings, the blade support body 50 may be fastened to the frame 10 using a separate bracket, so long as the blade support body 50 is reliably supported.

Meanwhile, the elastic member 70 is provided at a lower position in the space 53 of the blade support body 50 so that, when the vertical movable member 40, to which the pushing force of the temperature sensing cylinder 20 has been applied, is released, the elastic member 70 biases the vertical movable member 40 upwards.

Preferably, the elastic member 70 comprises a coil spring. As well, the elastic member 70 is fitted over a vertical movement guide shaft 56 of the blade support body 50.

Furthermore, the vertical movement guide shaft 56 is inserted into a guide hole 44 formed through the vertical movable member 40, thus guiding vertical movement of the vertical movable member 40.

Figure 5:
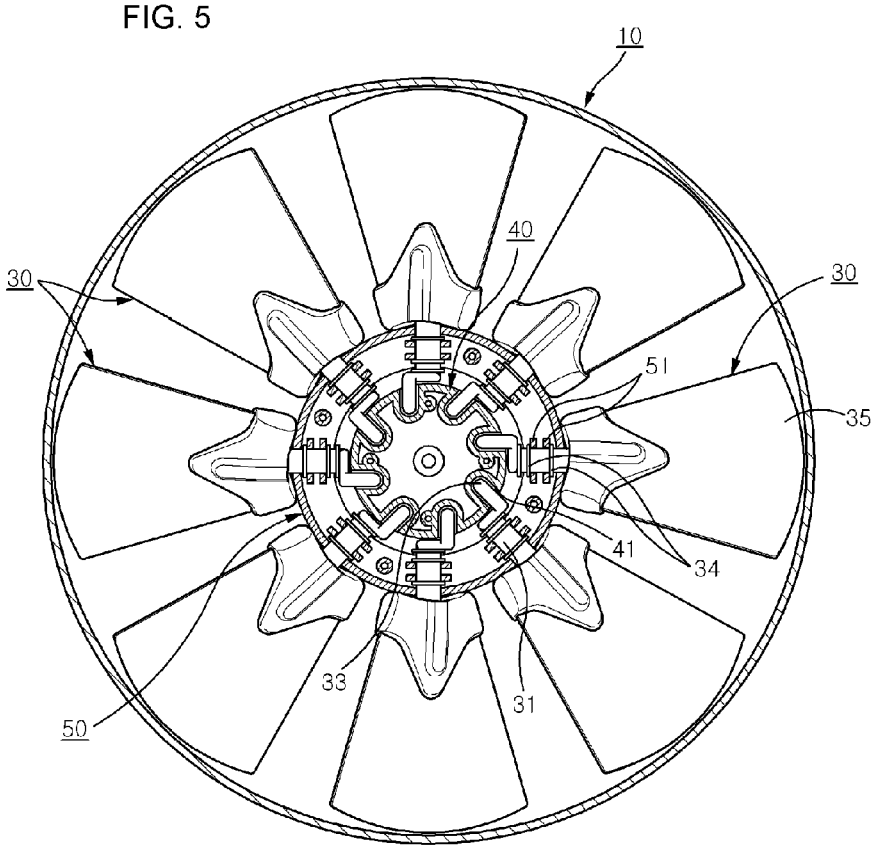
FIG. 5 is a sectional view taken along line Y-Y' of FIG. 3.

FIG. 5 shows the air guide blade assemblies 30, which are coupled to the vertical movable member 40 and the blade support body 50 and spaced apart from each other at regular angular intervals.

Figure 6:
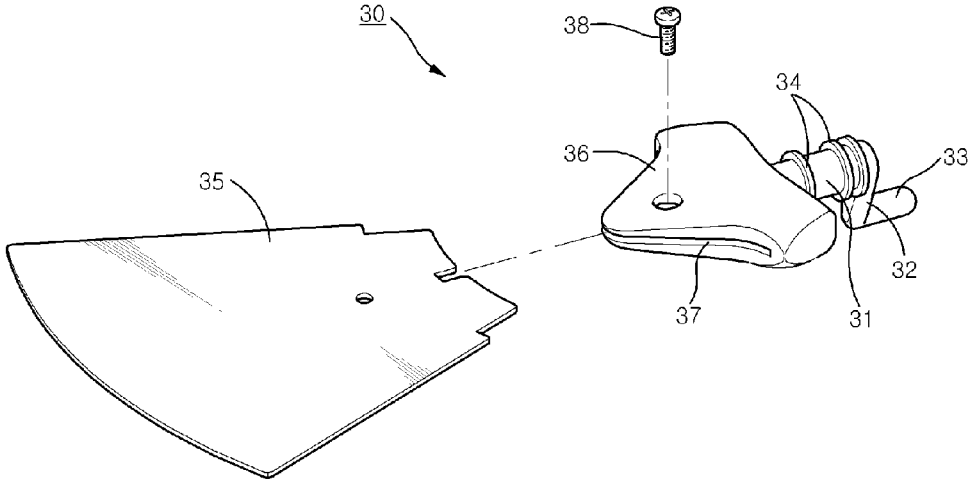
FIG. 6 is an exploded perspective view showing an air guide blade assembly of the air conditioning diffuser according to the present invention.

Each air guide blade assembly 30 may be formed in an integrated structure. Alternatively, as shown in FIG. 6, the blade 35 of each air guide blade assembly 30 may be made of a metal plate through a separate manufacturing process.

Figure 7:
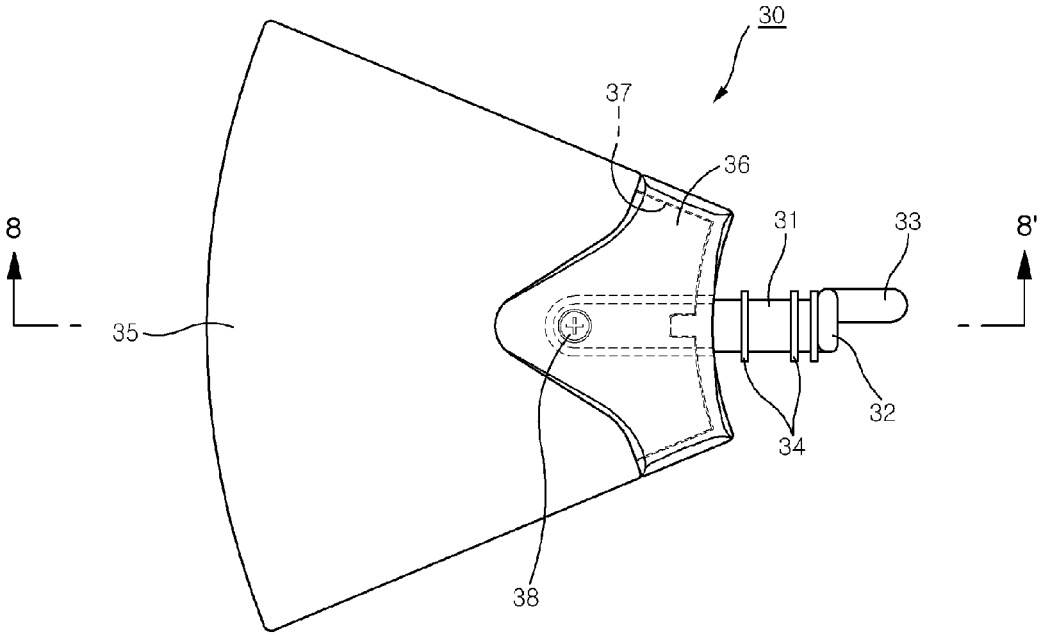
FIG. 7 is a view showing the assembled air guide blade assembly of FIG. 6.
Figure 8:
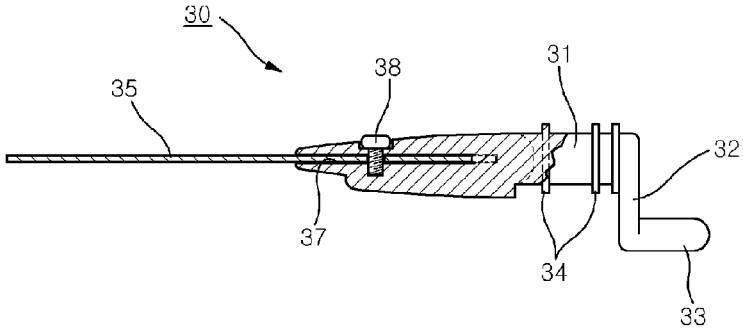
FIG. 8 is a sectional view taken along line Z-Z' of FIG. 7.

In detail, as shown in FIGS. 7 and 8, a coupling part 36 is provided on an end of the rotating shaft 31 of each air guide blade assembly 30, with an insertion slot 37 defined in the coupling part 36. The blade 35, which is made of metal, is inserted into the insertion slot 37 and is fastened to the coupling part 36 using a screw 38.

Figure 9:
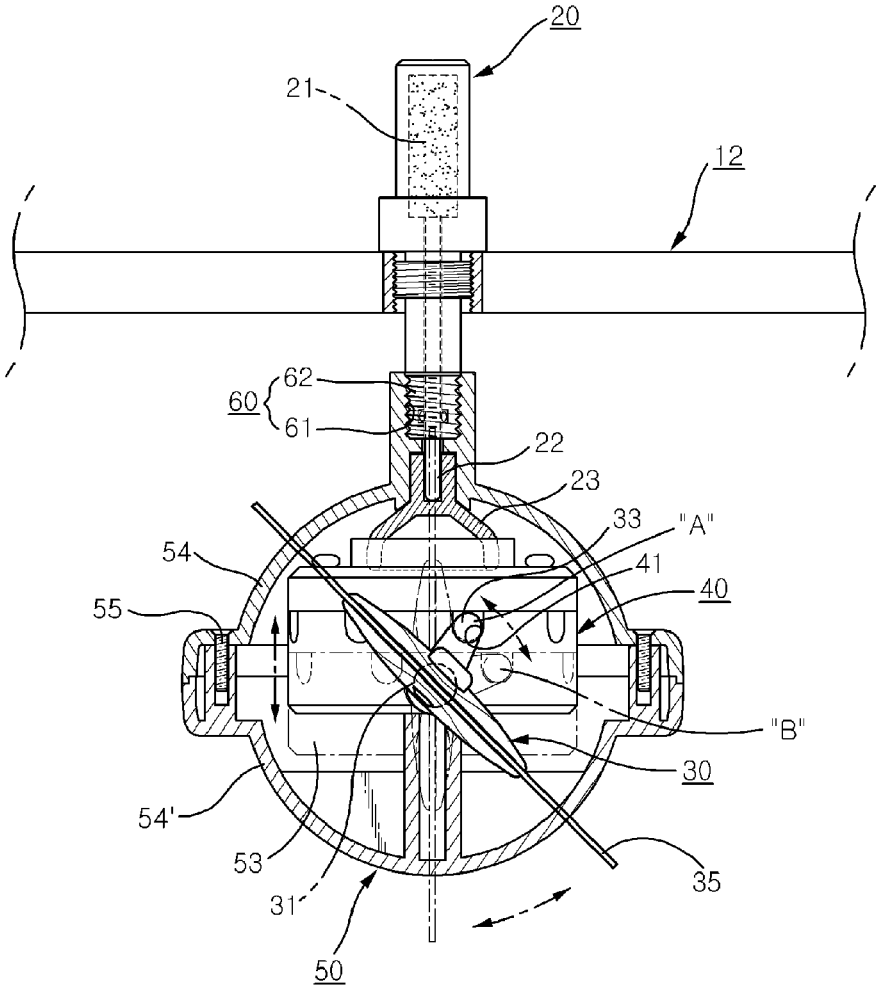
FIG. 9 is a sectional view showing the operation of the critical part of the air conditioning diffuser according to the present invention.

FIG. 9 is a view showing the operation of the present invention. The wax 21 of the temperature sensing cylinder 20 is in a contracted state at approximately 17° C. and is in an expanded state at approximately 27° C.

Therefore, while cold air is applied, the piston rod 22 is in a state of being retracted into the temperature sensing cylinder 20. Simultaneously, the vertical movable member 40 maintains the state of being disposed at the upper position.

At this time, the blades 35 of the air guide blade assemblies 30 are in states of being tilted, as shown in a solid line in FIG. 9.

Accordingly, in the case that cold air is applied, the cold air is guided by the blades 35 such that it is supplied into the room in a downward and sideways direction.

On the other hand, while hot air is applied, the heat of the hot air is transferred to the wax 21 in the temperature sensing cylinder 20, so that the wax 21 is expanded by the increased temperature.

Then, the expanded wax 21 pushes the piston rod 22 outwards, so that the piston rod 22 is advanced from the temperature sensing cylinder 20, and thus pushes downwards the vertical movable member 40.

Hence, the vertical movable member 40 is moved downwards. Thereby, the eccentric rotating shafts 33 of the air guide blade assemblies 30 are rotated downwards, that is, from a position designated by character "A" of FIG. 9 to a position designated by character "B". As a result, the rotating shafts 31 are rotated, and the blades 35 are thus rotated in vertical directions, as shown in a dashed line in FIG. 9.

Figure 10:
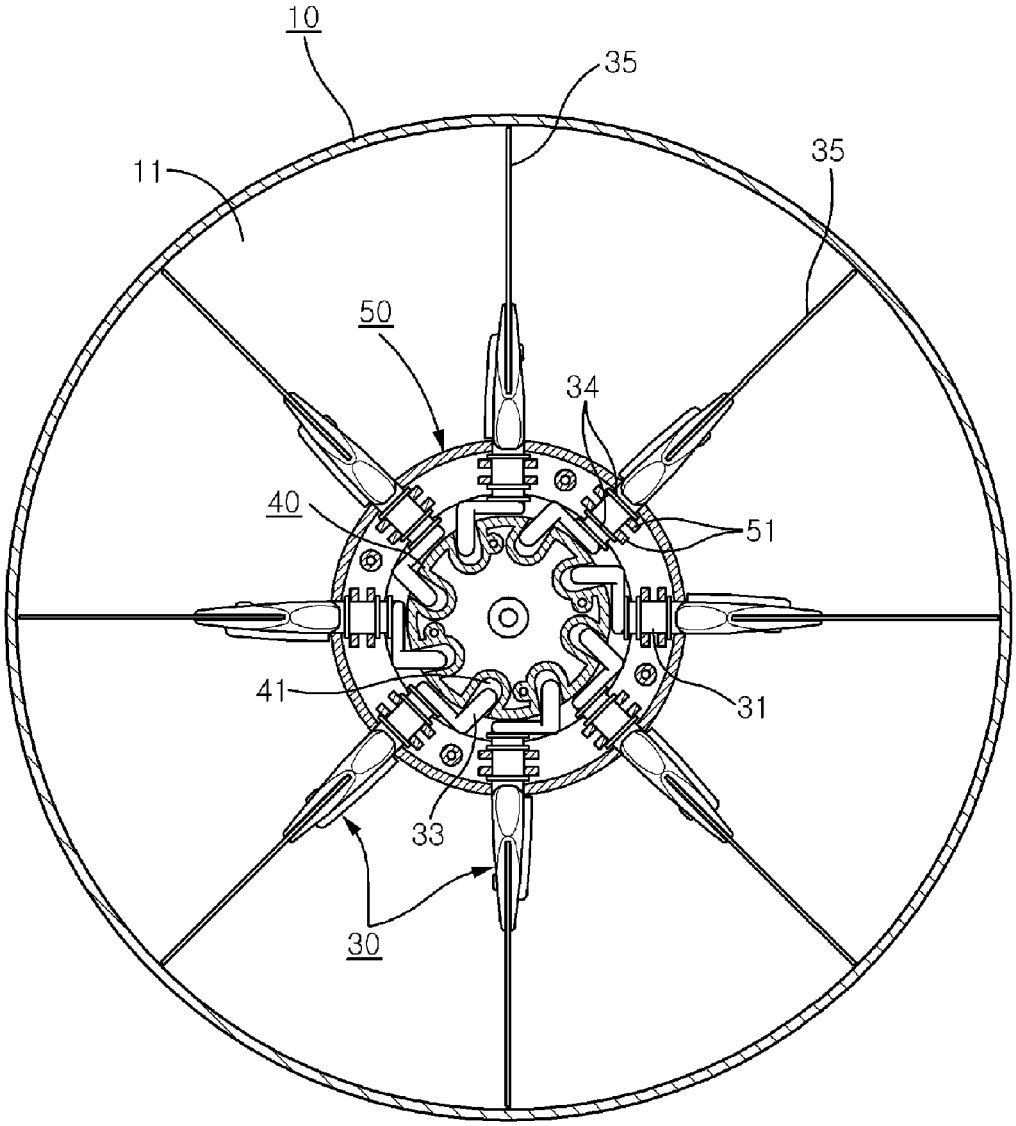
FIG. 10 is a plan sectional view showing the air conditioning diffuser when in a hot-air guide state, according to the present invention.

At this time, as shown in FIG. 10, the vertical movable member 40 is slightly rotated in a circumferential direction while being moved downwards, but the eccentric rotating shafts 33 of the air guide blade assemblies 30 are not removed from the eccentric shaft seats 41 of the vertical movable member 40.

As such, when the blades 35 of the air guide blade assemblies 30 are rotated in vertical directions, hot air, having passed through the air passage 11 of the frame 10, is supplied into the room in a vertical direction. Furthermore, the air conditioning diffuser of the present invention maintains this state, so long as hot air is supplied.

Figure 11:
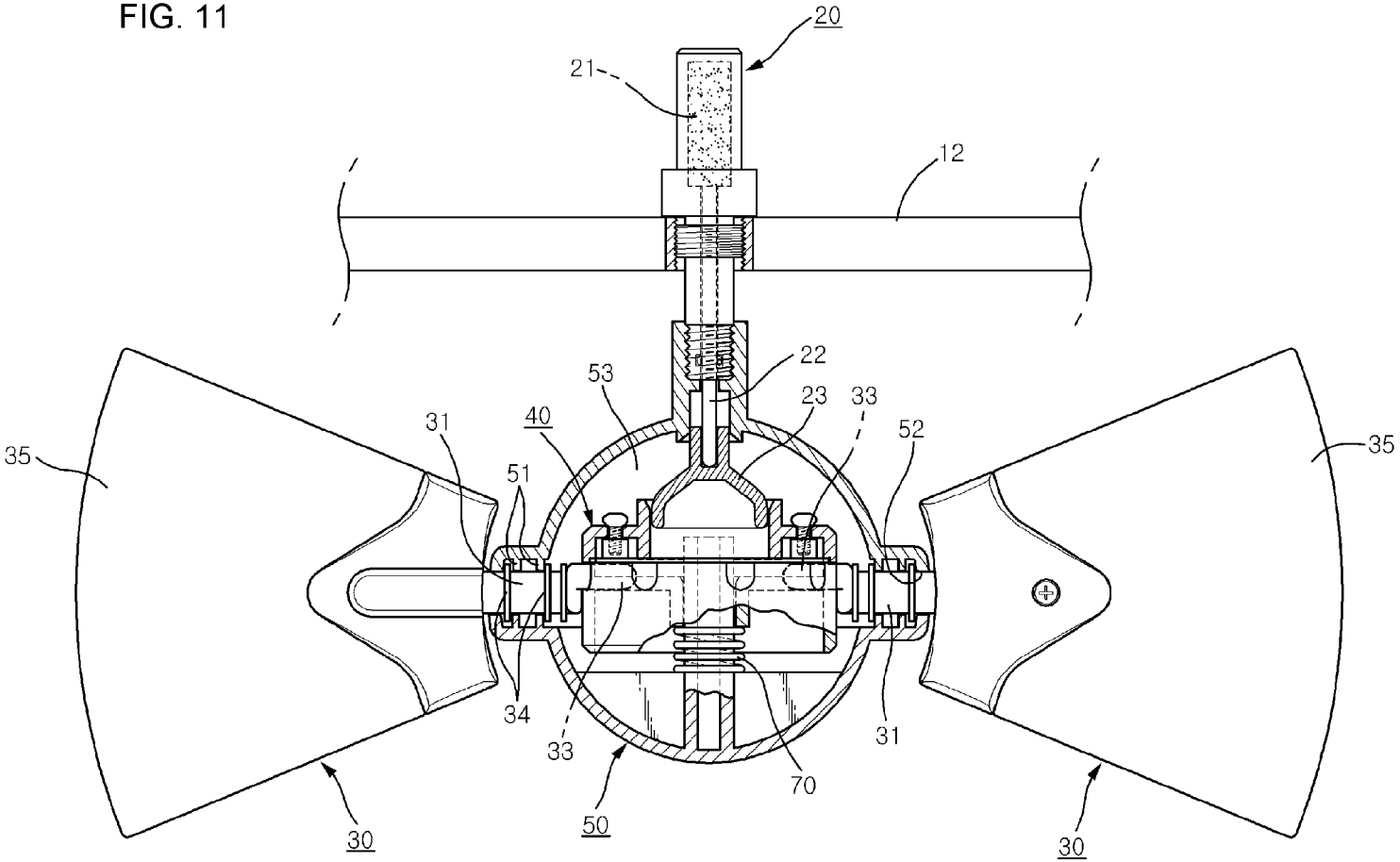
FIG. 11 is a sectional view showing the important part of the air conditioning diffuser when in the hot-air guide state, according to the present invention.

As well, while hot air is supplied, because the vertical movable member 40 is maintained in the lower position, the elastic member 70 maintains a state of being compressed, as shown in FIG. 11.

In this state, if cold air is supplied, the wax 21 of the temperature sensing cylinder 20 gives heat to the cold air. Thereby, the temperature of the wax 21 is reduced, so that the wax 21 is contracted.

Then the wax 21, having pushed the piston rod 22, releases the piston rod 22. Hence, the vertical movable member 40, the pushing member 23 and the piston rod 22 are moved together upwards by the elasticity of the elastic member 70.

Thereby, the eccentric rotating shafts 33 of the air guide blade assemblies 30 are rotated from position "B" of FIG. 9 to position "A". As a result, the rotating shafts 31 are rotated, and the blades 35 are thus rotated in tilted directions, as shown in the solid line in FIG. 9.

Therefore, in this state, cold air is guided by the blades 35 and is supplied into the room in a downward and sideways direction.

Figure 12:
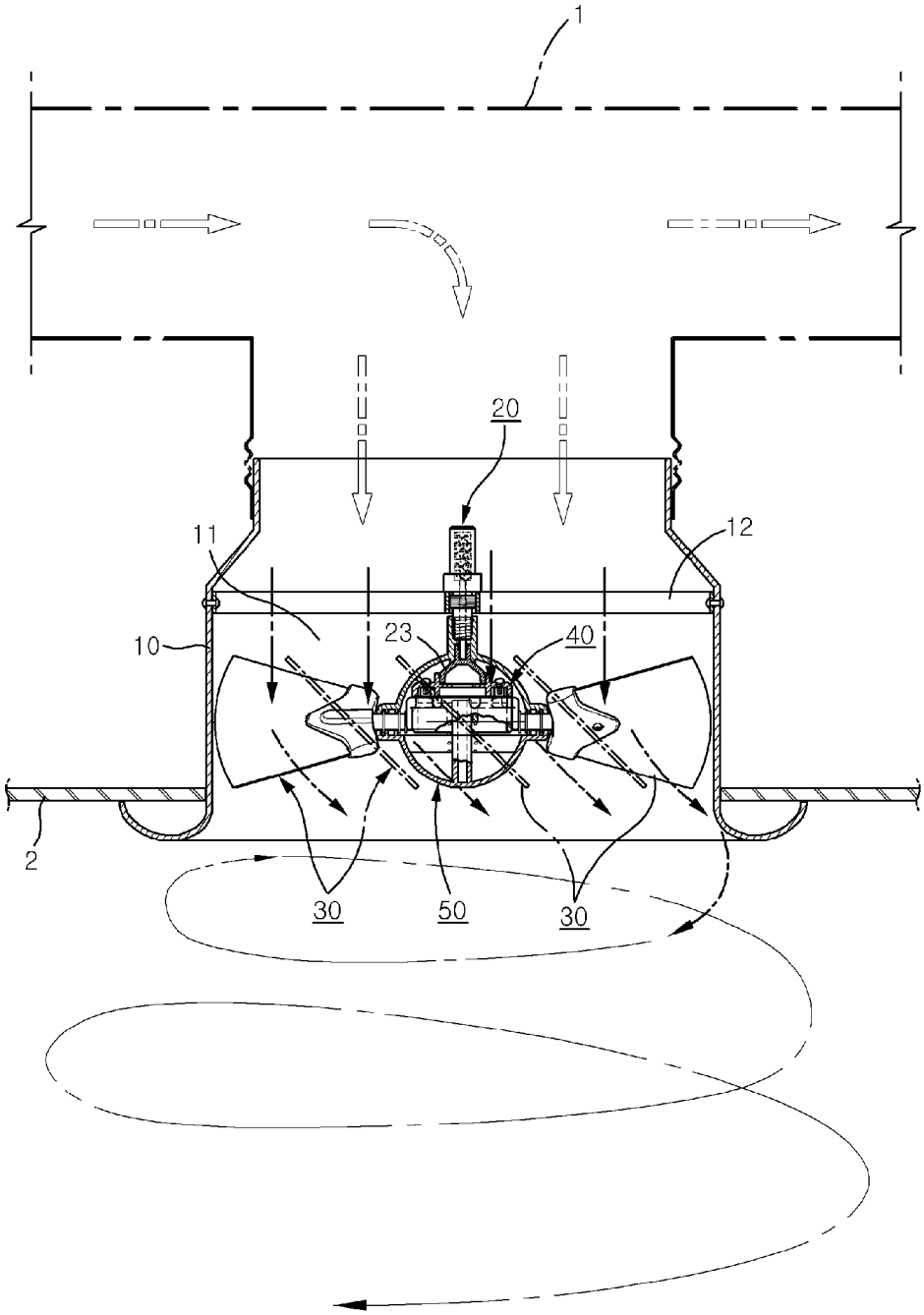
FIG. 12 is a sectional view showing the air conditioning diffuser when in the cold-air guide state, according to the present invention.

Furthermore, as shown in FIG. 12, the cold air that is being discharged from the diffuser is bumped against the circumferential inner surface of the frame 10, thus swirling when being supplied into the room.

Meanwhile, in the case that the air conditioning diffuser of the present invention is constructed such that the air guide blade assemblies 30 are placed below the frame 10, cold air is blown in a horizontal direction without being bumped against the circumferential inner surface of the frame 10.

Figure 13:
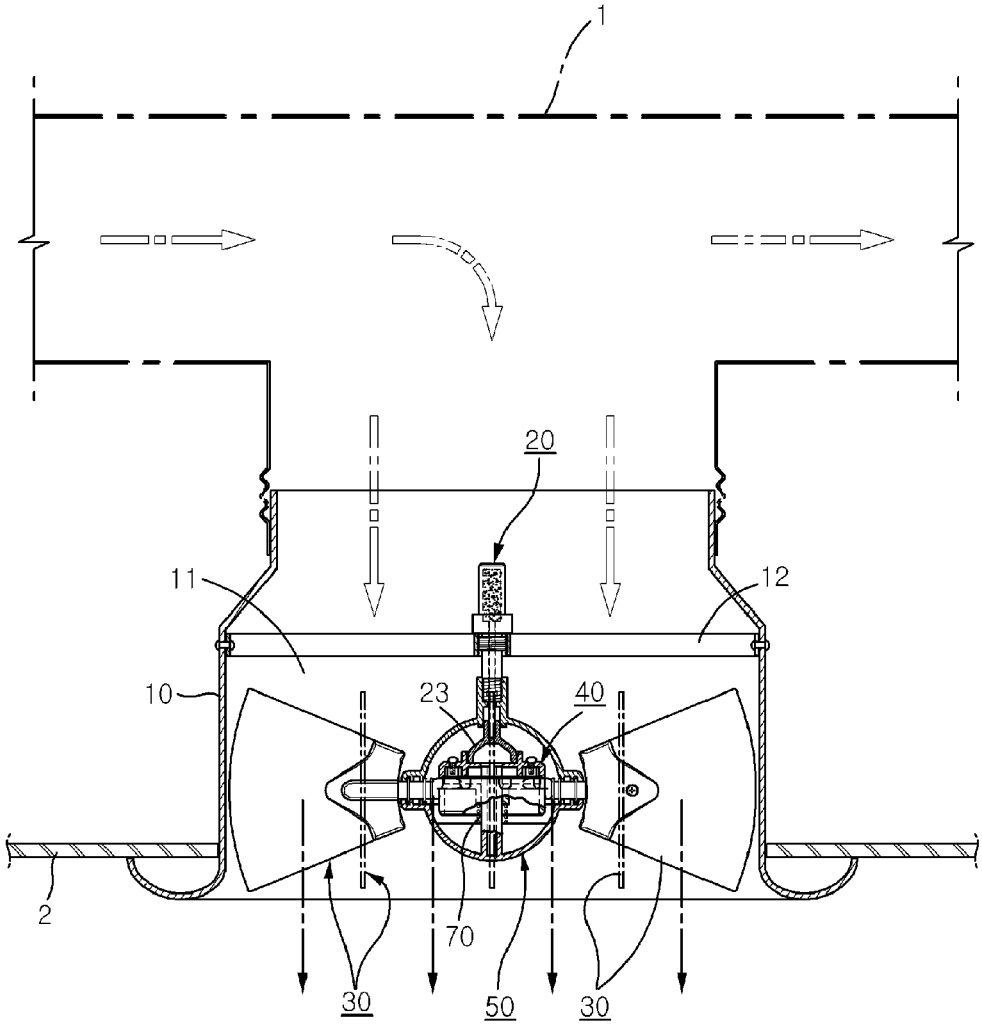
FIG. 13 is a sectional view showing the air conditioning diffuser when in a hot-air guide state, according to the present invention.

FIG. 13 shows hot air being supplied in a vertical direction while the blades 35 of the air guide blade assemblies 30 are oriented in a vertical direction.

INDUSTRIAL APPLICABILITY

As described above, the present invention provides an air conditioning diffuser which has a function of automatically changing the direction in which cold or hot air is supplied into a room depending on the temperature of the air. Therefore, the present invention does not require a user to change an air supply direction of the diffuser according to each season, thus being more convenient for the user.

The invention claimed is:

1. An air conditioning diffuser having a function of automatically changing an air supply direction, comprising:

a frame fastened to a ceiling of a room and communicating with an air duct through which cold or hot air passes, with an air passage defined in the frame so that the cold or hot air is supplied from the air duct to the room through the air passage;

a temperature sensing cylinder mounted to a support bracket fastened to the frame in the air passage, with a wax charged in the temperature sensing cylinder to expand or contract depending on a temperature of the cold or hot air passing through the air passage, and a piston rod provided in the temperature sensing cylinder such that the piston rod is advanced from a lower end of the temperature sensing cylinder by expansion of the wax;

a blade support body coupled to the lower end of the temperature sensing cylinder using coupling means, with a plurality of removal prevention supports provided in a circumferential outer rim of the blade support body and spaced apart from each other at regular angular intervals, and a plurality of rotating shaft seats formed in the respective removal prevention supports and in an outside wall of the rim;

a pushing member coupled to a lower end of the piston rod and placed in the blade support body;

a vertical movable member provided in a space defined in the blade support body to ensure movement of the vertical movable member therein, the vertical movable member being pushed downwards by the pushing member when the wax is expanded, with a plurality of eccentric shaft seats formed around an intermediate portion on a circumferential outer surface of the vertical movable member and spaced apart from each other at regular angular intervals;

a plurality of air guide blade assemblies supported by the blade support body, each of the air guide blade assemblies comprising: a blade exposed outside the blade support body; a rotating shaft extending from the blade and rotatably seated in the respective rotating shaft seats of the blade support body, with a stopper provided on an outer surface of the rotating shaft and stopped by each of the removal prevention supports of the blade support body; a connection part extending from the rotating shaft in a predetermined direction; and an eccentric rotating shaft protruding from the connection part so as to be eccentric from the rotating shaft, the eccentric rotating shaft inserted into each of the eccentric shaft seats of the vertical movable body so that, when the vertical movable member is moved upwards or downwards, the eccentric rotating shafts are moved upwards or downwards, thereby the blades are rotated around the rotating shafts in a closing or opening direction; and an elastic member provided under the vertical movable member at a lower position in the space of the blade support body so that, when the vertical movable member is released from the pushing member by contraction of the wax of the temperature sensing cylinder, the elastic member biases the vertical movable member upwards.

2. The air conditioning diffuser according to claim 1, wherein the vertical movable member comprises an upper body and a lower body, and the eccentric shaft seats are formed in an upper surface of the lower body, so that the upper body is coupled to the lower body using locking means, while the eccentric rotating shafts of the air guide blade assemblies are inserted into the eccentric shaft seats of the lower body.

3. The air conditioning diffuser according to claim 1, wherein the blade support body comprises an upper body and a lower body, so that the upper body and the lower body are coupled to each other using locking means, while the rotating shafts of the air guide blade assemblies are placed in the rotating shaft seats.

4. The air conditioning diffuser according to claim 1, wherein the coupling means for coupling the blade support body to the temperature sensing cylinder comprises: a threaded coupling hole formed in an upper end of the blade support body; and a lower threaded part provided on the lower end of the temperature sensing cylinder and engaging with the threaded coupling hole.

5. The air conditioning diffuser according to claim 1, wherein each of the air guide blade assemblies further comprises: a coupling part provided on an end of the rotating shaft, with an insertion slot defined in the coupling part, so that the blade is inserted into the insertion slot and is fastened to the coupling part using locking means.

* * * * *